United States Patent [19]

Gerard

[11] 4,026,170

[45] May 31, 1977

[54] MANUAL ENCAPING AND RECAPING DEVICE FOR BOTTLES SEALED WITH CROWN CAPS

[76] Inventor: Robert Gerard, 14, avenue Ruchonnet CH-1003, Lausanne, Switzerland

[22] Filed: Apr. 7, 1976

[21] Appl. No.: 674,318

[30] Foreign Application Priority Data

Apr. 8, 1975 France ..... 75.10970

[52] U.S. Cl. ..... 81/3.43; 81/3.46 R

[51] Int. Cl.² ..... B67B 5/00; B67B 7/16

[58] Field of Search ..... 81/3.34, 3.4, 3.44, 81/3.1 R, 3.43, 64, 3.46 R

[56] References Cited

UNITED STATES PATENTS

| | | | |
|---|---|---|---|
| 1,712,987 | 5/1929 | Forster | 81/3.44 UX |
| 1,797,106 | 3/1931 | Sweeney | 81/3.44 |

FOREIGN PATENTS OR APPLICATIONS

| | | | |
|---|---|---|---|
| 574,388 | 3/1958 | Italy | 81/3.1 R |

*Primary Examiner*—Al Lawrence Smith
*Assistant Examiner*—Roscoe V. Parker
*Attorney, Agent, or Firm*—Browdy and Neimark

[57] ABSTRACT

A manual uncapping and recapping device for bottles with a crown cap closure includes a cap tightening and extracting ring articulated to a lever handle. The handle has fixedly connected thereto a reverse-pitch two-thread shaft. The ring comprises two semicircular parts connected at one end and having parallel extensions at the other end which engage the respective threads of the shaft. The end of the lever handle opposite the hand grip (and adjacent the ring) serves as a pressure element. By pivoting the handle upward or downward the ring may be tightened or expanded.

7 Claims, 4 Drawing Figures

MANUAL ENCAPING AND RECAPING DEVICE FOR BOTTLES SEALED WITH CROWN CAPS

FIELD OF THE INVENTION

The present invention relates to an opening and closing device for a bottle provided with a metal crown-type cap, the edge of which is crimped around the bottle's neck to seal it, and more particularly, to a new hand tool enabling a user to uncap and recap a bottle provided with such a sealing system as often as desired and in an automatic fashion.

BACKGROUND OF THE INVENTION

Bottles fitted with crown-type caps for beer, mineral water, fruit juices, etc. have been known and used for several decades and are held in high esteem because of their properties of airtightness and low cost. Furthermore, such crown-type caps are adaptable for use on conventional necks which have low-fragility during storage, transport, and ahndling operations.

Many hand tools have been developed and marketed to enable these caps to be removed easily and without risk. However, it is practically impossible to recap the bottles with these caps because the latter are deformed by uncapping and no longer have their hermetic properties; it is then necessary if recapping is desired, which is frequently the case for carbonated beverages, to employ one of the various models of stoppers on the market.

It has been suggested that devices enabling such caps to be refitted onto their original bottles be developed. For example, a lever-handled tool has been devised which at one end is provided with a cap-removing claw and at the other end with an open circular ring which adjusts to the diameter of the cap, the ring being made to grip the edge of the cap firmly by rotating the lever in the horizontal plane of the ring. However, such an operation is delicate and usually causes the cap itself to rotate on the bottle neck to such a point that the achievement of hermetic recapping may be considered a phenomenon of pure chance.

A tool has also been recommended whereby a lever handle plays the role of a cam, articulating on a flexible split ring so as to enable this ring to tighten again by rocking the handle. For a number of years a bottle-recapping system by cooperation of a grip hinged on such a ring has been on the market. According to a variation based on the same principle, the articulation shaft of the handle can be mounted on flexible claws which are an extension of the ring and the latter can be fitted in a known manner with uncapping claws so that the uncapping and recapping operations can be combined with the same tool. In this embodiment, however, there is the problem of wear of the metal parts in contact, in particular the flexible claws of the ring and the lips of the V-slit handle provided for passage of these lips at each rocking movement of the grip.

SUMMARY OF THE INVENTION

The present invention enables the above-mentioned disadvantages to be overcome and the problem of automatically opening and closing bottles with stoppers or crown caps to be ingeniously solved by proposing a hand tool of simple design enabling the cap to be removed without deforming it, requiring no particular physical strength on the part of the user, and permitting long life due to its sturdiness.

The new device according to the present invention also calls on the known use of a cap-gripping and extraction ring hinged to the lateral supports of a lever handle together with an element for pressing on this ring, but it incorporates the improvement that the ring is made of two semicircular parts which are firmly connected together at one end and are each extended by a perforated arm at the other end. The two arms are substantially parallel to each other and are hinged to the lateral supports of the handle by a reverse pitch two-thread shaft. Pivoting the handle from top to bottom or vice versa causes contraction or expansion respectively of the ring opening by tightening or loosening its two semicircular parts.

In practice, according to an advantageous embodiment, the connection between the two parts of the ring is brought about by a rod fitted in a loop formed from each free end of the ring parts, the rod serving as a hinge pin. Before introduction of the fitted rod, a tongue or element to be gripped, serving as the pressure point during the recapping operation, is inserted between the two loops. In addition, the threaded shaft is non-diplaceably mounted on the two lateral supports of the handle, its forward and backward rotation being accomplished by downward or upward movement of the handle. Thus the transmission of forces exerted on the two-part ring and causing tightening or loosening thereof is effected by relatively rigid elements which are quite able to tolerate stress.

According to another characteristic of the present invention, the parallel arms which terminate one end of each ring element are each provided on their outside faces in contact with the reverse pitch threaded shaft with a lock nut (or equivalent device) fitted on the arms.

According to yet another characteristic of the present invention, the two semicircular parts of the ring are each provided, near the arm extending them, with a claw or lug to engage under the flutings of the cap when the latter is removed. In addition, the upper part of the ring, on the side of the pressure element, is provided with several tongues folded over approximately toward the center of the ring and designed to bear on the cap when it is removed.

According to an advantageous embodiment, the pressure element which is an extension of the lever handle is composed of a circular or polygonal part, the inside face of which, on the ring side, has at its center a projection designed to leave a trace of the cap and thus prevent any fraud.

BRIEF DESCRIPTION OF THE DRAWINGS

The present invention will be better understood from the detailed description of a nonlimitative embodiment by reference to the FIGURES in the attached page of drawings wherein.

DETAILED DESCRIPTION OF PREFERRED EMBODIMENT

Figure 1:
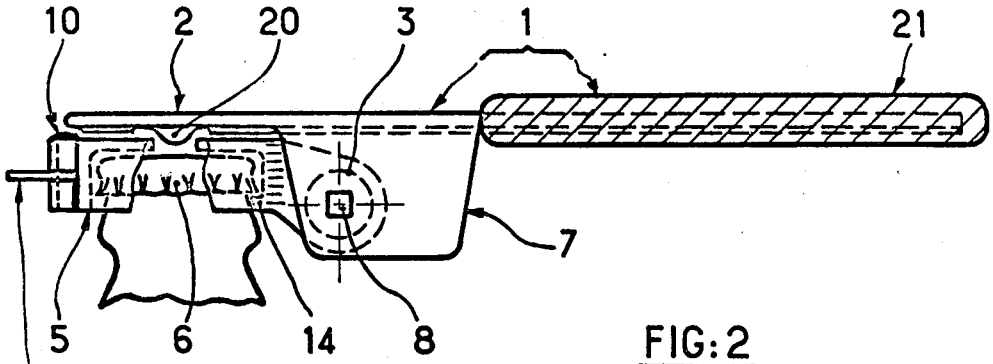
FIG. 1 represents a side view of a hand tool according to the invention.

In general, the tool according to the present invention shown in the FIGURES comprises essentially a lever handle 1, one end of which 2 plays the role of a pressure element. The handle 1 is connected by a threaded shaft 3 to arms 12 to a ring 5 designed for gripping and removal of a metal cap 6 of the crown type.

Figure 2:
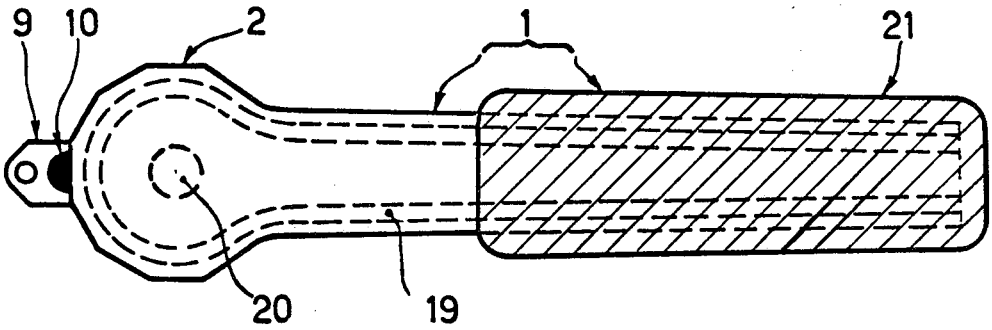
FIG. 2 shows this same tool in a top view.

The part of lever handle 1 held by the user's hand is provided with a grip 21 (made of molded plastic, for example) to make it easier to hold. Immediately after this grip, two folded-down sides 7 act as supports for threaded shaft 3 to which ring 5 is connected. The front part of sides 7, which acts as a pressure element 2 designed to cover ring 5 by pressing thereon when cap 6 is removed, can have the shape of a circle or of a polygon (for example a decagon or dodecagon, see FIG. 2). Threaded shaft 3 is kept integral and fixed with respect to handle 1 between sides 7 by means of a square section 8 (or the like) mounted on both sides of shaft 3. This square section, when mounted, fits in a recess of the same shape made in each of the ends of supporting sides 7. The assembly is force-fitted together to make it rigid.

Figure 3:
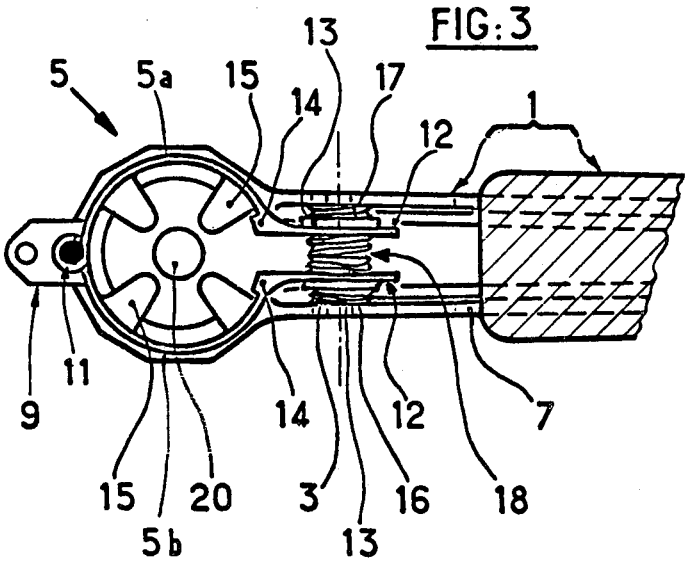
FIG. 3 illustrates the tool in a view from below such as to show the gripping removal ring and the attachment thereof to the reverse-pitch double-thread device permitting an articulated link between the ring and the tool handle.
Figure 4:
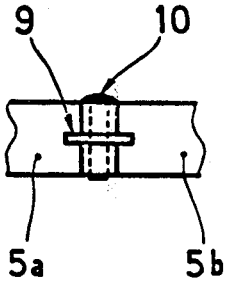
FIG. 4 illustrates an assembly detail of the two parts of the ring at one of their ends.

Gripping ring 5 is composed of a relatively flexible steel ring in the shape of two semicircles *5a* and *5b* (see FIG. 3) the upper curved ends of which enclose a tongue 9 situated in the plane of the ring. The semicircles *5a* and *5b* are assembled by any known means, for example by introduction of a rod 10 into small loop 11, the rod then being locked in place to play the role of a hinge pin. The lower ends of the two parts *5a* and *5b* of the ring are themselves shaped into two substantially parallel arms 12 which are introduced by a perforation (not shown) onto threaded shaft 3 and held in place at each end by a lock nut 13. Each part of the ring is provided, near arm 12, with a claw or lug 14 designed to fit under the flutings of the cap when the latter is removed.

Moreover, ring 5 is provided with elements supplying the fitting function of metal cap 6. In the embodiment shown in FIG. 3 it is provided at its upper part with four folded-back tongues 15 which converge toward the geometric center of the ring. The purpose of these tongues is to provide a seat for ring 5 on cap 6 and, under the influence of element 2, to exert a pressure facilitating the removal of cap 6.

Threaded shaft 3, integral with lever handle 1 by its attachment between lateral supports 7, has two wide-pitch threads 16 and 17, the pitches of which are opposite each other, namely one being a right-hand thread and the other a left-hand thread, separated from each other by a narrow neutral zone 18. These reverse threads enable arms 12 to tighten against each other or loosen by a rotational movement downward or upward respectively or lever handle 1. These movement cause contraction or expansion of ring 5, respectively.

Tongues 15 or ring 5 may be supplied on their inside faces with a small lug or other projection (not shown) the purpose of which is to make a light mark on cap 6 without deforming it. The presence of such a lug is not however necessary if the shape of these tongues enables the same result to be achieved, as the pointed end of the latter can suffice to make a mark on the cap.

In addition, handle 1, in its part forming a pressure element 2, in addition to stiffening ribs 19, advantageously has a projection 20 situated in the center of the circular or polygonal part 2 and designed to enable a mark to be left on the cap and thus prevent any fraud.

The operation of the novel hand tool according to the present invention is extremely easy and does not require great stength on the part of the user.

To open a bottle fitted with a metal cap 6, one need only place ring 5 on the cap with claws 14 engaging under its flutings and then effect an upward movement of lever handle 1. Removal of the cap is immediate and is facilitated by projection 20 of pressure element 2 which bears on cap 6. When it is removed from the neck of the bottle, the cap is not deformed and thus preserves its hermetic property enabling it to be reused.

To close the bottle with the same cap, the latter, which generally remains in gripping ring 5, must be replaced on the neck and engaged on the collar thereof by a slight pressure. Kept perpendicular by means of tongue 9 situated forward of ring 5, lever handle 1 is operated by a downward movement causing ring 5 to tighten again around cap 6. The latter is then perfectly seated on the bottle which once more completely seals the liquids and gases contained therein.

In practice, the new uncapper-recapper according to the present invention can be made of various metals and alloys, for example nickel steel, the grip 21 being made of suitable plastic or other material such as wood or the like.

In addition, the tool is designed for adaptation to the two sizes of caps universally used, namely 26 mm for carbonated or noncarbonated liquid caps and 29 mm for wines. Only the sides of the two parts of gripping ring 5 are different.

It will be obvious to those skilled in the art that various changes may be made without departing from the scope of the invention and the invention is not to be considered limited to what is shown in the drawings and described in the specification.

What is claimed is:

1. A manual uncapping and recapping device for bottles with a crown cap closure, comprising:

a cap-tightening and extracting ring comprising two semicircular parts connected together at one end and having parallel extensions at the other end, each extension having a perforation therein, a lever handle having a handgrip at one end and a pressure element at the other end, said lever handle, substantially intermediate said two ends, having lateral supports extending downwardly from each side thereof;

a reverse-pitch two-thread shaft fixedly connected between said lateral supports, the perforations of said extensions each engaging one thread of said two-threaded shaft, whereby downward and upward pivoting, of said lever handle causes contraction or expansion of the opening of said ring by tightening or loosening the two semicircular parts thereof.

2. A device in accordance with claim 1 wherein said two semicircular parts each have a loop formed therein at the end at which said parts are connected together, and further including a rod fitted into said loops and serving as a hinge pin for connecting said parts.

3. A device in accordance with claim 2 further including a perforated tongue inserted between said two loops before introduction of said rod.

4. A device in accordance with claim 1 further including lock nuts fitted on the outer faces of said perforated extensions in contact with said shaft.

5. A device in accordance with claim 1 wherein the two semicircular parts of the ring are each provided, at the point from which said extensions extend, with a claw or lug means for fitting under the flutings of the cap when the latter is removed.

6. A device in accordance with claim 1, wherein the upper part of said ring, on the side thereof adjacent said pressure element, is provided with several tongues folded approximately toward the center of said ring and intended to bear on the cap when the latter is removed.

7. A device in accordance with claim 1 wherein the pressure element comprises a circular or polygonal part, the face thereof adjacent said ring having a projection means at the center thereof for leaving a mark on the cap and thus preventing fraud.

* * * * *